United States Patent [19]

Kawaguchi

[11] Patent Number: 4,627,641

[45] Date of Patent: Dec. 9, 1986

[54] TWO-COLOR THERMOSENSITIVE LABEL

[75] Inventor: Hatsuo Kawaguchi, Shiga, Japan

[73] Assignee: Kabushiki Kaisha Ishida Koki Seisakusho, Kyoto, Japan

[21] Appl. No.: 522,568

[22] Filed: Aug. 12, 1983

[30] Foreign Application Priority Data

Aug. 12, 1982 [JP] Japan ..... 57-123128[U]

[51] Int. Cl.[4] ..... G09F 3/00; G09F 3/10

[52] U.S. Cl. ..... 283/81; 346/76 R; 346/76 PH; 346/135.1

[58] Field of Search ..... 283/1 A, 81; 346/76 R, 346/76 PH, 135.1; 40/2 R

[56] References Cited

U.S. PATENT DOCUMENTS

| | | | |
|---|---|---|---|
| 3,813,677 | 5/1984 | Shimotsuma . | |
| 4,328,977 | 5/1982 | Ozawa et al. . | |
| 4,447,818 | 5/1984 | Kurata et al. | 346/76 PH |
| 4,495,507 | 1/1985 | Moriguchi et al. | 346/76 PH |

FOREIGN PATENT DOCUMENTS

| | | | |
|---|---|---|---|
| 0000657 | 2/1979 | European Pat. Off. . | |
| 58-7393 | 1/1983 | Japan | 346/76 R |
| 0144209 | 3/1983 | Japan . | |
| 57-91286 | 12/1983 | Japan | 346/76 R |
| 1543583 | 4/1979 | United Kingdom . | |
| 2069160 | 8/1981 | United Kingdom . | |

*Primary Examiner*—Robert L. Spruill
*Assistant Examiner*—Taylor J. Ross
*Attorney, Agent, or Firm*—Staas & Halsey

[57] ABSTRACT

A thermosensitive label wherein plural kinds of color developing material for developing different colors at approximately the same temperature are applied to a label substrate at predetermined, separate locations, enabling characters of different colors to be printed on the same label by a thermal printer.

3 Claims, 2 Drawing Figures

TWO-COLOR THERMOSENSITIVE LABEL

BACKGROUND OF THE INVENTION

This invention relates to a thermosensitive label capable of developing a number of colors.

A weighing and pricing apparatus currently in wide use operates by weighing a product by means of an electronic scale, printing such information as product name, unit price, weight and overall price on a label by a printer operatively associated with the electronic scale, packing the weighed product and then adhering the printed label to the surface of the product package.

Various labels and printers are employed in the above-described apparatus. One form of label in wide use is a thermosensitive label, which is so designed that only those portions of the label heated to a prescribed temperature of, e.g., about 80° to 90° C., will change color. To print characters on a thermosensitive label in accordance with the prior art, a length of strippable paper carrier having a predetermined number of the thermosensitive labels adhered thereto is loaded into a thermal printer, and the paper carrier is fed through the printer at prescribed increments. Within the printer, a thermosensitive printing head is brought into pressured contact with the thermosensitive labels adhered to the paper carrier, and predetermined ones of a multiplicity of heating elements in the printing head are momentarily heated to print the abovementioned information on the labels at designated locations.

With the foregoing conventional method, however, the label is capable of developing only a single color, such as the color black, so that certain items of printed information cannot be emphasized or made easier to read by distinguishing them from other items of information by means of different colors.

Although there has been developed a thermosensitive label capable of developing two colors such as black and red by changing the temperature of the applied heat, it is not possible to rapidly change the heating temperature produced by the heating elements of the printing head. This makes it difficult to change the color of a row of print simultaneously from one color to the other during printing. The end result is that thermoprinting is performed through use of only one color, say black or red.

SUMMARY OF THE INVENTION

Accordingly, an object of the present invention is to provide a thermosensitive label on which characters can be printed in a variety of colors by means of a thermal printer, thereby rendering the printed information easier to read and enabling certain information to be emphasized.

According to the present invention, the foregoing object is attained by providing a thermosensitive label which includes a substrate, a color developing material applied to a surface of the substrate at a predetermined location for developing a color at a prescribed temperature, and at least one other color developing material applied to the surface of the substrate at another predetermined location for developing another color at a temperature approximately equal to the prescribed temperature. Different colored characters or the like can be printed on the same thermosensitive label with an ordinary thermal printer by applying the same temperature to the various color developing areas simultaneously by means of the thermal printing head.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

Figure 1:
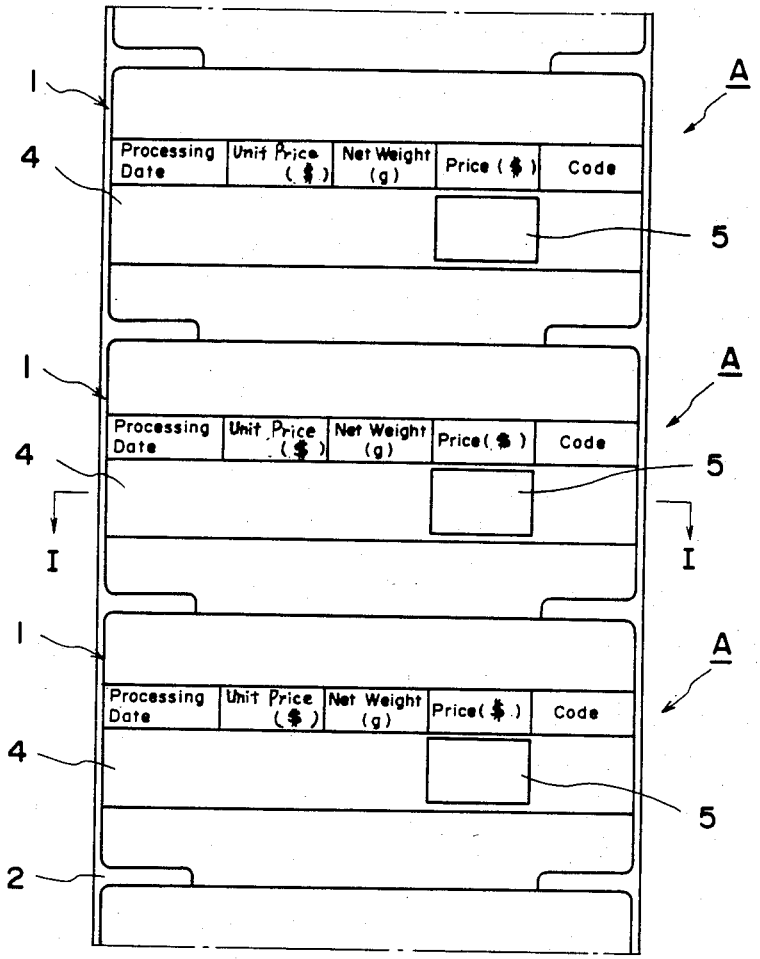
FIG. 1 is a plan view of a thermosensitive label according to the present invention.
Figure 2:
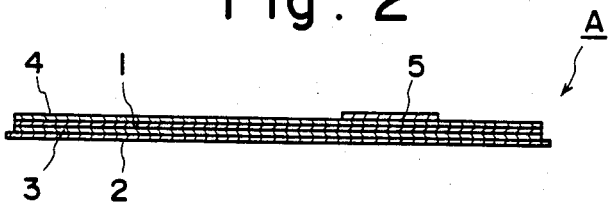
FIG. 2 is a sectional view taken along line I—I of FIG. 1.

With reference to the drawings, a thermosensitive label according to the present invention is designated at A. The thermosensitive label A includes a substrate 1 the reverse side (underside) of which is adhered to a strip of carrier paper 2 by means of an adhesive 3. As shown in FIG. 1, a number of the thermosensitive labels A are adhered in successive fashion to the strip of carrier paper 2. In use, the thermosensitive labels A, following the printing of information thereon by a thermal printer, are stripped off the carrier paper 2 one at a time and are adhered to weighed, packaged products.

The thermosensitive label A, in addition to the substrate 1, further comprises a first color developing material 4 applied over the entire obverse side (top side) thereof for developing a first color, e.g., black, when heated to a prescribed temperature, and a second color developing material 5 applied to the surface of the first color developing material 4 at a predetermined location for developing a second color, e.g., red, which is different from the first color, when heated to approximately the same temperature as the first color developing material 4. Characters for a predetermined label format reading, eg., "PROCESSING DATE", "CODE", the shop's name, and including even graphics, may be printed on the surface of the first color developing material 4 by an ordinary ink printer. Numerical information and the like which may change from day to day is printed on the color developing material 4 under the proper heading by a thermal printer. In the illustrated embodiment, the second color developing material 5 is to have a price printed thereon by a thermal printer and is therefore applied to the surface of the first color developing material 4 in the "PRICE" column where the thermosensitive label A is to show said information, i.e., the product price.

In printing, the thermosensitive label A, borne by the carrier paper 2, is loaded into an ordinary thermal printer where prescribed locations on the label A are heated to print predetermined information such as product name, processing date, unit price, weight and price. With the thermosensitive label A of the illustrated embodiment, the information in all columns, with the exception of the "PRICE" column (FIG. 1), will be printed in black. Only the information in the latter column will be printed in red, owing to the second color developing material 5 applied thereto. Thus, characters of two colors can be printed on the same thermosensitive label without using different temperatures. The use of different printing colors makes the label easier to read and allows certain information, such as price, to be emphasized.

In the illustrated embodiment, only two color developing materials are applied to the substrate 1 of the thermosensitive label A. This does not represent a limitation, however, as a plurality of different color developing materials may be applied to permit the printing of characters in various colors.

The thermosensitive label of the present invention may be manufactured in the following manner.

Monochromatic thermosensitive paper is readily available in the form of an elongated sheet of considerable length and width rolled into a roll of some diameter. The thermosensitive paper consists of a paper backing, the entire obverse side of which has a color developing material already applied thereto. The paper backing and color developing material constitute the substrate 1 and the first color developing material 4, respectively, of the illustrated embodiment. To manufacture the thermosensitive label, this thermosensitive sheet is pulled from the roll as the latter rotates, during which time the adhesive 3 is applied to the entire reverse side of the sheet. Meanwhile, the carrier paper 2 in sheet form is pulled from a roll thereof having the same width as the thermosensitive sheet and is brought into contact with the reverse side of the thermosensitive sheet so that the two sheets are laminated and bonded together by the adhesive 3. During this process, the laminated sheets are taken up by a separate roll after being cut. Specifically, a plurality of cutters are disposed in side-by-side relation in the path of the laminated sheets being taken up by the last-mentioned roll and serve to cut the laminated sheets into a plurality of elongated strips of considerable width, corresponding approximately to four or five times the length of the final product label (i.e., the lateral dimension of the label shown in FIG. 1).

Next, the roll of strips having the aforementioned width is loaded into an ordinary, e.g., ink, printing machine which prints plural rows of the label format onto each strip, the format including the label frame and items reading "PROCESSING DATE", "PRICE", "CODE", etc. The machine also cuts each wide strip, consisting of the laminated carrier paper and thermosensitive sheet, into strips of a width equivalent to the length of the final product label and, at the same time, cuts solely the thermosensitive sheet transversely without severing the carrier paper. Unused portions of the carrier paper, namely portions from which the labels are absent, are taken up and removed by a separate roll. The second color developing material 5 may also be printed on (in ink) by the printing machine during this step.

The foregoing manufacturing steps provide a number of thermosensitive label rolls each consisting of an elongated strip containing a multiplicity of the labels adhered individually to the underlying paper carrier. The final step is to rewind each roll onto a paper core of specified dimensions. The total number of labels wound onto the core will depend upon the user's instructions. A typical figure is 5,000 to 10,000 labels.

The above-described manufacturing steps are performed automatically by machine. Moreover, even if the thermosensitive label produced is capable of developing plural colors, the steps for manufacturing the same are only a few more than required for the monochromatic thermosensitive label. Accordingly, there is but little influence upon manufacturing cost.

In accordance with the present invention as described and illustrated hereinabove, color developing materials each capable of developing a different color at approximately the same applied temperature are formed on a substrate at predetermined, separate locations. Characters having different colors can therefore be printed by a thermal printer on the same thermosensitive label, allowing the printed information to be read more easily and emphasized when desired.

As many apparently widely different embodiments of the present invention can be made without departing from the spirit and scope thereof, it is to be understood that the invention is not limited to the specific embodiments thereof except as defined in the appended claims.

What is claim is:

1. A thermosensitive label, comprising:

a label substrate; and first and second color developing materials, said first color developing material being applied over the entire label substrate, said second color developing material being applied over said label substrate at a predetermined location, and said first and second color developing materials being selectively developable to provide respective colors by application of approximately the same temperatures to respective portions of said locations where the respective colors are desired.

2. The label of claim 1, wherein each said color developing material is formed as a respective layer extending over the respective predetermined location, and the selective development results in the resepective color of the uppermost layer of any of said color developing materials in each said respective portion being developed.

3. A multicolor thermosensitive label, comprising:

a label substrate;

a first color developing material, applied over the label substrate, capable of being selectively developed to provide a first color by application of thermal energy having a temperature; and a second color developing material, applied over the first color developing material at predetermined locations, capable of being selectively developed to provide a second color by application of thermal energy having approximately the same temperature as the thermal energy applied to the first color developing material.

* * * * *